US011585579B2

(12) United States Patent
Tashiro et al.

(10) Patent No.: US 11,585,579 B2
(45) Date of Patent: Feb. 21, 2023

(54) REFRIGERATION CYCLE APPARATUS

(71) Applicant: Mitsubishi Electric Corporation, Tokyo (JP)

(72) Inventors: Yusuke Tashiro, Tokyo (JP); Yasuhide Hayamaru, Tokyo (JP); Masakazu Kondo, Tokyo (JP); Masakazu Sato, Tokyo (JP); Naoki Nakagawa, Tokyo (JP); Atsushi Kawashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 255 days.

(21) Appl. No.: 17/043,135

(22) PCT Filed: May 23, 2018

(86) PCT No.: PCT/JP2018/019845
§ 371 (c)(1),
(2) Date: Sep. 29, 2020

(87) PCT Pub. No.: WO2019/224945
PCT Pub. Date: Nov. 28, 2019

(65) Prior Publication Data

US 2021/0095905 A1 Apr. 1, 2021

(51) Int. Cl.
*F25B 47/02* (2006.01)
*F25B 41/20* (2021.01)
(Continued)

(52) U.S. Cl.
CPC ..... *F25B 47/025* (2013.01); *F24F 1/30* (2013.01); *F25B 41/20* (2021.01); *F25B 49/02* (2013.01);
(Continued)

(58) Field of Classification Search
CPC ..... F25B 49/02; F25B 2313/025; F25B 2347/021; F25B 2313/009
See application file for complete search history.

(56) References Cited

U.S. PATENT DOCUMENTS 10,520,233 B2 * 12/2019 Watanabe ..... F24F 11/89
11,268,743 B2 * 3/2022 Watanabe ..... F25B 47/025
(Continued)

FOREIGN PATENT DOCUMENTS

JP 2008-064381 A 3/2008
JP 2008-157558 A 7/2008
(Continued)

OTHER PUBLICATIONS

International Search Report of the International Searching Authority dated Aug. 14, 2018 for the corresponding International application No. PCT/JP2018/019845 (and English translation).
(Continued)

*Primary Examiner* — Henry T Crenshaw
(74) *Attorney, Agent, or Firm* — Posz Law Group, PLC

(57) ABSTRACT

The refrigeration cycle apparatus includes a refrigerant circuit, a controller to control the refrigerant circuit, a bypass flow path, and a flow control valve. The bypass flow path communicates between the discharge side of the compressor and the first outdoor heat exchanger or between the discharge side of the compressor and the second outdoor heat exchanger. The flow control valve is provided to the bypass flow path. The refrigerant circuit is configured to be able to perform a heating defrosting simultaneous operation. The heating defrosting simultaneous operation is an operation of supplying part of the refrigerant discharged from the compressor to one of the first outdoor heat exchanger and the second outdoor heat exchanger via the bypass flow path, causing the other of the first outdoor heat exchanger and the second outdoor heat exchanger to serve as an evaporator, and causing the indoor heat exchanger to serve as a condenser.

2 Claims, 6 Drawing Sheets

(51) Int. Cl.
*F24F 1/30* (2011.01)
*F25B 49/02* (2006.01)

(52) U.S. Cl.
CPC ... *F25B 2313/009* (2013.01); *F25B 2313/025* (2013.01); *F25B 2313/0292* (2013.01); *F25B 2313/02741* (2013.01); *F25B 2347/021* (2013.01); *F25B 2700/21171* (2013.01)

(56) References Cited

U.S. PATENT DOCUMENTS

| | | | | |
|---|---|---|---|---|
| 2018/0266743 | A1* | 9/2018 | Watanabe | F24F 11/89 |
| 2018/0328635 | A1 | 11/2018 | Tashiro et al. | |

FOREIGN PATENT DOCUMENTS

| | | | |
|---|---|---|---|
| JP | 4272224 | B2 | 6/2009 |
| JP | 2010-281492 | * | 12/2010 |
| JP | 2010-281492 | A | 12/2010 |
| WO | 2017/094148 | A1 | 6/2017 |

OTHER PUBLICATIONS

Office Action dated Sep. 2, 2021 issued in corresponding CN patent application No. 201880092513.6 (and Machine Translation).
Extended European Search Report dated May 10, 2021 issued in corresponding European patent application No. 18919812.0.
Office Action dated Jun. 22, 2021 issued in corresponding JP patent application No. 2020-520933 (and English translation).

* cited by examiner

REFRIGERATION CYCLE APPARATUS

CROSS REFERENCE TO RELATED APPLICATION

This application is a U.S. national stage application of PCT/JP2018/019845 filed on May 23, 2018, the contents of which are incorporated herein by reference.

TECHNICAL FIELD

The present invention relates to a refrigeration cycle apparatus capable of performing a heating defrosting simultaneous operation.

BACKGROUND ART

Patent Literature 1 describes an air-conditioning apparatus including a refrigeration cycle. An outdoor heat exchanger of the refrigeration cycle is divided into a lower heat exchanger, and an upper heat exchanger larger than the lower heat exchanger. The discharge side of the compressor is coupled to each of the lower heat exchanger and the upper heat exchanger by a hot-gas bypass. The hot-gas bypass is provided with two bypass opening and closing valves, one corresponding to the lower heat exchanger and the other corresponding to the upper heat exchanger. A controller of the air-conditioning apparatus is configured to, when initiating defrosting during heating operation, perform an operation of defrosting the upper heat exchanger while carrying out heating with the lower heat exchanger, then perform an operation of defrosting the lower heat exchanger while carrying out heating with the upper heat exchanger, and after the latter operation is finished, return to the heating operation. Patent Literature 1 describes that the air-conditioning apparatus mentioned above simultaneously performs defrosting and heating to ensure indoor comfort while also allowing for reduced defrost time.

CITATION LIST

Patent Literature

Patent Literature 1: Japanese Unexamined Patent Application Publication No. 2008-64381

SUMMARY OF INVENTION

Technical Problem

The air-conditioning apparatus according to Patent Literature 1 is merely configured to, in simultaneously performing heating and defrosting, cause one of the two bypass opening and closing valves to open. This means that with the air-conditioning apparatus according to Patent Literature 1, the ratio between the heating capacity and the defrost capacity is constant. Consequently, in some circumstances, one of the heating capacity and the defrost capacity may become excessive relative to the load.

The present invention has been made to address the above-mentioned problem, and accordingly it is an object of the invention to provide a refrigeration cycle apparatus with which, during heating defrosting simultaneous operation, the ratio between the heating capacity and the defrost capacity can be adjusted in accordance with the load.

Solution to Problem

A refrigeration cycle apparatus according to an embodiment of the present invention includes a refrigerant circuit, and a controller. The refrigerant circuit includes a compressor, an indoor heat exchanger, a first outdoor heat exchanger, and a second outdoor heat exchanger, and circulates refrigerant. The controller is configured to control the refrigerant circuit. The refrigerant circuit further includes a bypass flow path, and a flow control valve. The bypass flow path communicates between the discharge side of the compressor and the first outdoor heat exchanger or between the discharge side of the compressor and the second outdoor heat exchanger. The flow control valve is provided at the bypass flow path. The indoor heat exchanger is configured to exchange heat between the refrigerant and a heating target. The refrigerant circuit is configured to be able to perform a heating defrosting simultaneous operation. The heating defrosting simultaneous operation is an operation of supplying part of the refrigerant discharged from the compressor to one of the first outdoor heat exchanger and the second outdoor heat exchanger via the bypass flow path, causing the other of the first outdoor heat exchanger and the second outdoor heat exchanger to serve as an evaporator, and causing the indoor heat exchanger to serve as a condenser. The controller is configured to, during the heating defrosting simultaneous operation, control the opening degree of the flow control valve based on the temperature of the heating target.

Advantageous Effects of Invention

According to an embodiment of the present invention, during heating defrosting simultaneous operation, the opening degree of the flow control valve is controlled based on the temperature of a heating target. This makes it possible to direct excess heating capacity to the defrost capacity. Therefore, according to the embodiment of the present invention, during heating defrosting simultaneous operation, the ratio between the heating capacity and the defrost capacity can be adjusted in accordance with the load.

DESCRIPTION OF EMBODIMENTS

Embodiment 1

Figure 1:
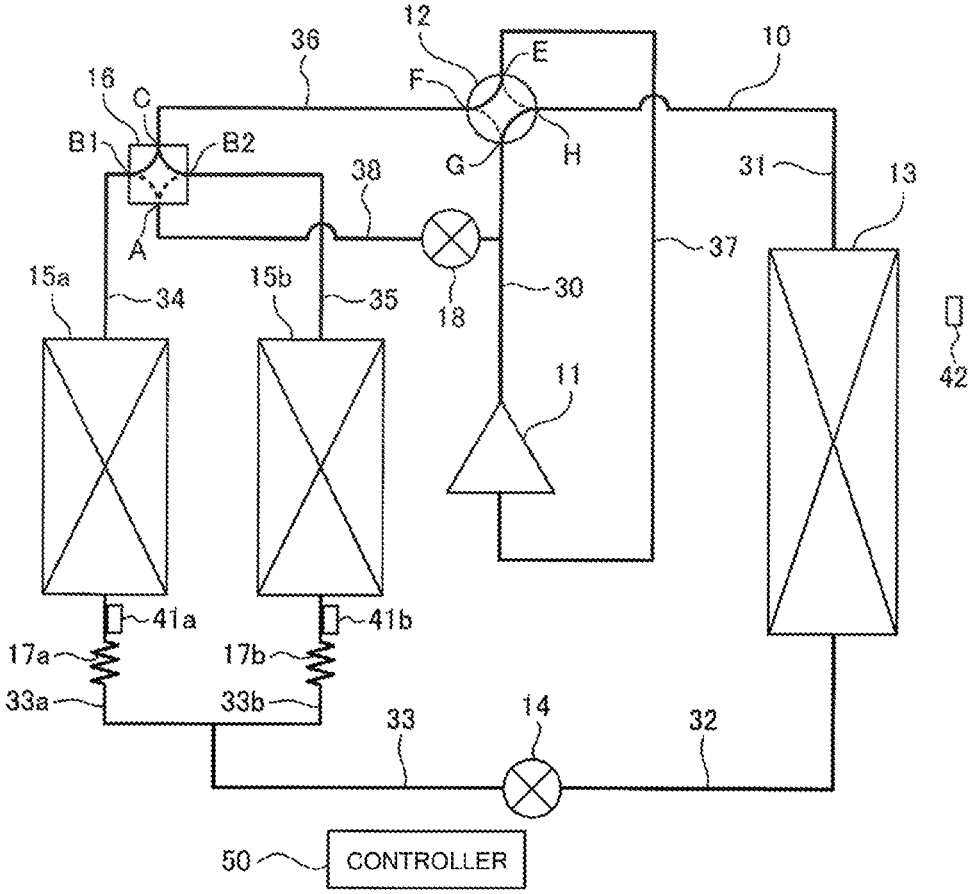
FIG. 1 is a refrigerant circuit diagram illustrating the configuration of a refrigeration cycle apparatus according to Embodiment 1 of the present invention.

A refrigeration cycle apparatus according to Embodiment 1 of the present invention will be described below. FIG. 1 is a refrigerant circuit diagram illustrating the configuration of a refrigeration cycle apparatus according to Embodiment 1. In Embodiment 1, an air-conditioning apparatus will be described as an exemplary refrigeration cycle apparatus. As illustrated in FIG. 1, the refrigeration cycle apparatus includes a refrigerant circuit 10 that circulates refrigerant. The refrigerant circuit 10 includes a compressor 11, a first flow switching device 12, an indoor heat exchanger 13, an expansion valve 14, a first outdoor heat exchanger 15*a*, a second outdoor heat exchanger 15*b*, and a second flow switching device 16. As will be described later, the refrigerant circuit 10 is configured to be able to perform a heating operation, a reverse-cycle defrosting operation (to be referred to simply as "defrosting operation" hereinafter), a heating defrosting simultaneous operation, and a cooling operation.

The refrigeration cycle apparatus includes an outdoor unit installed outdoors, and an indoor unit installed indoors. The compressor 11, the first flow switching device 12, the expansion valve 14, the first outdoor heat exchanger 15*a*, the second outdoor heat exchanger 15*b*, and the second flow switching device 16 are accommodated in the outdoor unit, and the indoor heat exchanger 13 is accommodated in the indoor unit. Further, the refrigeration cycle apparatus includes a controller 50 to control the refrigerant circuit 10.

The compressor 11 is a fluid machine that sucks and compresses low-pressure gas refrigerant, and discharges the resulting refrigerant as high-pressure gas refrigerant. An example of a compressor that can be used as the compressor 11 is an inverter-driven compressor whose operating frequency can be adjusted.

The first flow switching device 12 switches the directions of refrigerant flow within the refrigerant circuit 10. As the first flow switching device 12, a four-way valve with four ports E, F, G, and H is used. The first flow switching device 12 can assume a first state and a second state. In the first state, as represented by solid lines in FIG. 1, the port E communicates with the port F, and the port G communicates with the port H. In the second state, as represented by dashed lines in FIG. 1, the port E communicates with the port H, and the port F communicates with the port G. The first flow switching device 12 is controlled by the controller 50 such that during heating operation and during heating defrosting simultaneous operation, the first flow switching device 12 is set in the first state, and during defrosting operation and during cooling operation, the first flow switching device 12 is set in the second state. The first flow switching device 12 may be a combination of plural valves such as two-way valves or three-way valves.

The indoor heat exchanger 13 is a heat exchanger configured to exchange heat between refrigerant flowing inside the heat exchanger, and indoor air sent by an indoor fan (not illustrated) accommodated in the indoor unit. The indoor heat exchanger 13 serves as a condenser during heating operation, and serves as an evaporator during cooling operation. Conditioned air that has passed through the indoor heat exchanger 13 is supplied to an indoor space. During heating operation, the air in the indoor space is a heating target to be heated by the air-conditioning apparatus, and during cooling operation, the air in the indoor space is a cooling target to be cooled by the air-conditioning apparatus.

The expansion valve 14 is a valve configured to reduce the pressure of refrigerant. An electronic expansion valve whose opening degree can be adjusted through control by the controller 50 is used as the expansion valve 14.

Each of the first outdoor heat exchanger 15*a* and the second outdoor heat exchanger 15*b* is a heat exchanger configured to exchange heat between refrigerant flowing inside the heat exchanger, and indoor air sent by an outdoor fan (not illustrated) accommodated in the outdoor unit. The first outdoor heat exchanger 15*a* and the second outdoor heat exchanger 15*b* each serve as an evaporator during heating operation, and serve as a condenser during cooling operation. The first outdoor heat exchanger 15*a* and the second outdoor heat exchanger 15*b* are connected in parallel with each other in the refrigerant circuit 10. Further, the first outdoor heat exchanger 15*a* and the second outdoor heat exchanger 15*b* are disposed in parallel or series with each other with respect to the flow of air. Alternatively, the first outdoor heat exchanger 15*a* and the second outdoor heat exchanger 15*b* may be formed by splitting a single horizontal-flow heat exchanger into two upper and lower halves. In this case, the first outdoor heat exchanger 15*a* and the second outdoor heat exchanger 15*b* are disposed in parallel with each other with respect to the flow of air.

The second flow switching device 16 is configured to switch how refrigerant flows between during heating operation, during defrosting operation and cooling operation, and during heating defrosting simultaneous operation. As the second flow switching device 16, a four-way valve with four ports A, B1, B2, and C is used. The second flow switching device 16 can assume a first state, a second state, and a third state. In the first state, as represented by solid lines in FIG. 1, the port C communicates with both the port B1 and the port B2, and the port A communicates with neither the port B1 nor the port B2. In the second state, the port A communicates with the port B1, and the port C communicates with the port B2. In the third state, the port A communicates with the port B2, and the port C communicates with the port B1. The second flow switching device 16 is controlled by the controller 50 such that during heating operation, during defrosting operation, and during cooling operation, the second flow switching device 16 is set in the first state, and during heating defrosting simultaneous operation, the second flow switching device 16 is set in the second state or the third state. An example of a valve used as the second flow switching device 16 is a flow switching valve described in International Publication No. 2017/094148.

The compressor 11, the first flow switching device 12, the indoor heat exchanger 13, the expansion valve 14, the first outdoor heat exchanger 15*a*, the second outdoor heat exchanger 15*b*, and the second flow switching device 16 are connected via refrigerant pipes such as pipes 30 to 37. The pipe 30 connects the discharge opening of the compressor 11 with the port G of the first flow switching device 12. The pipe 31 connects the port H of the first flow switching device 12 with the indoor heat exchanger 13. The pipe 32 connects the indoor heat exchanger 13 with the expansion valve 14. The pipe 33 branches off at a point into pipes 33*a* and 33*b*, which respectively connect the expansion valve 14 with the first outdoor heat exchanger 15*a* and with the second outdoor heat exchanger 15*b*. The pipes 33*a* and 33*b* are respectively provided with capillary tubes 17*a* and 17*b*. The pipe 34 connects the first outdoor heat exchanger 15*a* with the port B1 of the second flow switching device 16. The pipe 35 connects the second outdoor heat exchanger 15*b* with the port B2 of the second flow switching device 16. The pipe 36 connects the port C of the second flow switching device 16 with the port F of the first flow switching device 12. The pipe 37 connects the port E of the first flow switching device 12 with the suction opening of the compressor 11.

The refrigerant circuit 10 includes a bypass flow path 38 that connects the pipe 30, which is located near the discharge side of the compressor 11, with the port A of the second flow switching device 16. The bypass flow path 38 is configured to supply part of gas refrigerant discharged from the compressor 11, to the first outdoor heat exchanger 15*a* or the second outdoor heat exchanger 15*b* as hot gas. The bypass flow path 38 is provided with a flow control valve 18 to control the flow rate of refrigerant. An example of a valve used as the flow control valve 18 is an electronic expansion valve, a motor-operated valve, or other such valve whose opening degree is controlled by the controller 50 in a continuous or multi-step manner. The flow control valve 18 becomes closed when set to the minimum opening degree, and becomes open when set to an opening degree greater than the minimum opening degree. Desirably, the flow control valve 18 can assume at least a first opening degree, which is the minimum opening degree, a second opening degree, which is greater than the first opening degree, and a third opening degree, which is greater than the second opening degree. The flow control valve 18 is controlled by the controller 50 such that during heating operation, during defrosting operation, and during cooling operation, the flow control valve 18 is set in, for example, a closed state, and during heating defrosting simultaneous operation, the second flow switching device 16 is set in an open state at a predetermined opening degree. Control of the opening degree of the flow control valve 18 during heating defrosting operation will be described later. As necessary, a pressure reducing device such as a capillary tube may be provided to the bypass flow path 38.

A temperature sensor 41*a* is provided to a portion of the pipe 33*a* between the capillary tube 17*a* and the first outdoor heat exchanger 15*a*. The temperature sensor 41*a* detects, during a heating defrosting simultaneous operation performed to defrost the first outdoor heat exchanger 15*a*, the temperature of refrigerant leaving the first outdoor heat exchanger 15*a*. A temperature sensor 41*b* is provided to a portion of the pipe 33*b* between the capillary tube 17*b* and the second outdoor heat exchanger 15*b*. The temperature sensor 41*b* detects, during a heating defrosting simultaneous operation performed to defrost the second outdoor heat exchanger 15*b*, the temperature of refrigerant leaving the second outdoor heat exchanger 15*b*. In this regard, the temperature sensor 41*a* and the temperature sensor 41*b* are each provided to acquire the temperature of the heat exchanger to be defrosted during heating defrosting simultaneous operation. Accordingly, the temperature sensor 41*a* and the temperature sensor 41*b* may be respectively provided to the first outdoor heat exchanger 15*a* and the second outdoor heat exchanger 15*b*. The temperature sensors 41*a* and 41*b* are each configured to output a detection signal to the controller 50 described later.

In an air passage defined in the indoor unit, a temperature sensor 42 is disposed upstream of the indoor heat exchanger 13 to detect a room temperature, that is, the temperature of air in the indoor space. The temperature sensor 42 may be disposed in the indoor space. The temperature sensor 42 is configured to output a detection signal to the controller 50 described later.

The controller 50 has a microcomputer including a CPU, a ROM, a RAM, an I/O port, or other components. The controller 50 receives detection signals input from various sensors including the temperature sensors 41*a*, 41*b*, and 42, and an operation signal input from an operating unit that accepts an operation made by the user. Based on such input signals, the controller 50 controls operation of the entire refrigeration cycle apparatus, including the compressor 11, the first flow switching device 12, the expansion valve 14, the second flow switching device 16, the flow control valve 18, the indoor fan, and the outdoor fan.

Figure 2:
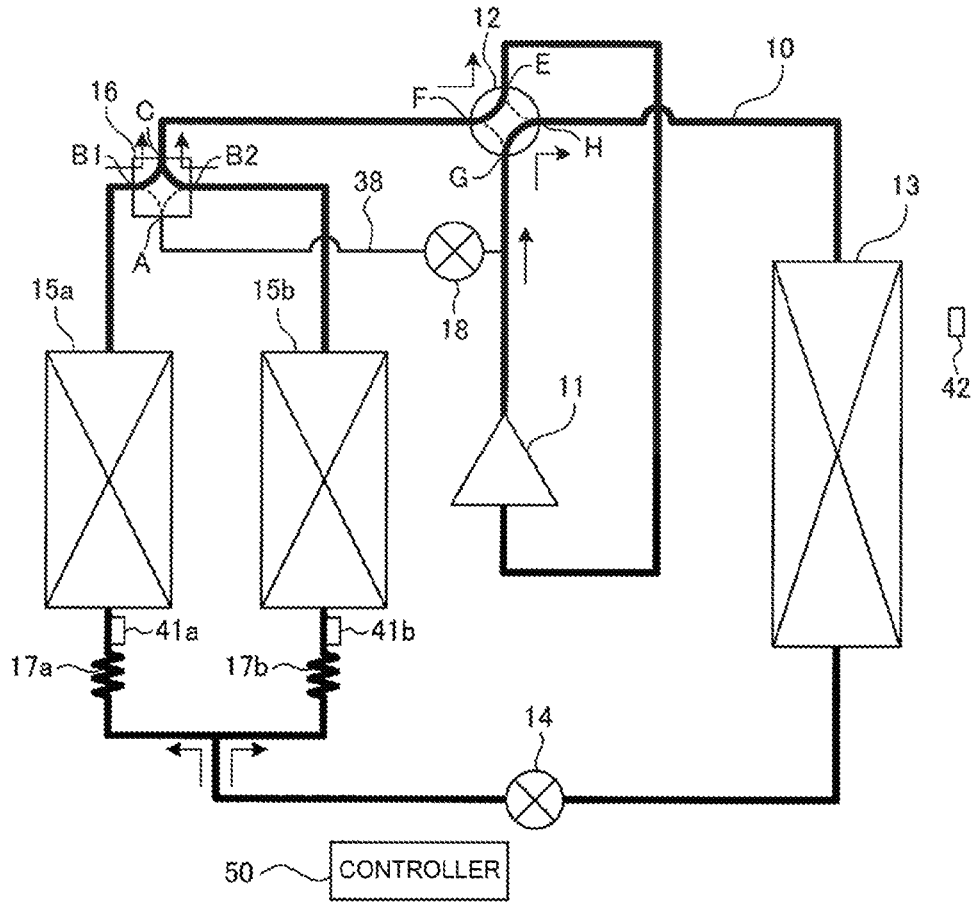
FIG. 2 illustrates a heating operation of the refrigeration cycle apparatus according to Embodiment 1 of the present invention.

A heating operation of the refrigeration cycle apparatus will be described below. FIG. 2 illustrates a heating operation of the refrigeration cycle apparatus according to Embodiment 1. As illustrated in FIG. 2, during heating operation, the first flow switching device 12 is set in the first state in which the port E communicates with the port F and the port G communicates with the port H. The second flow switching device 16 is set in the first state in which the port C communicates with both the port B1 and the port B2. The flow control valve 18 is set in, for example, a closed state.

High-pressure gas refrigerant discharged from the compressor 11 flows via the first flow switching device 12 into the indoor heat exchanger 13. During heating operation, the indoor heat exchanger 13 serves as a condenser. That is, in the indoor heat exchanger 13, heat is exchanged between refrigerant flowing inside the indoor heat exchanger 13, and indoor air sent by the indoor fan, and the heat of condensation of the refrigerant is rejected to the indoor air. The gas refrigerant entering the indoor heat exchanger 13 thus condenses into high-pressure liquid refrigerant. The indoor air sent by the indoor fan is heated by heat rejected from the refrigerant.

After leaving the indoor heat exchanger 13, the liquid refrigerant has its pressure reduced by the expansion valve 14 and changes to low-pressure two-phase refrigerant. After leaving the expansion valve 14, the two-phase refrigerant splits into two streams, one going to the pipe 33*a* and the other going to the pipe 33*b*. The two-phase refrigerant entering the pipe 33*a* is further reduced in pressure in the capillary tube 17*a* before entering the first outdoor heat exchanger 15*a*. The two-phase refrigerant entering the pipe 33*b* is further reduced in pressure in the capillary tube 17*b* before entering the second outdoor heat exchanger 15*b*.

During heating operation, the first outdoor heat exchanger 15*a* and the second outdoor heat exchanger 15*b* both serve as evaporators. That is, in each of the first outdoor heat exchanger 15*a* and the second outdoor heat exchanger 15*b*, heat is exchanged between refrigerant flowing inside the outdoor heat exchanger, and outdoor air sent by the outdoor fan, and the heat of evaporation of the refrigerant is removed from the outdoor air. As a result, the two-phase refrigerant entering the first outdoor heat exchanger 15*a* and the two-phase refrigerant entering the second outdoor heat exchanger 15*b* each evaporate into low-pressure gas refrigerant. The gas refrigerant leaving the first outdoor heat exchanger 15*a* and the gas refrigerant leaving the second outdoor heat exchanger 15*b* then combine in the second flow switching device 16, and the resulting gas refrigerant is sucked into the compressor 11 via the first flow switching device 12. Upon entering the compressor 11, the gas refrigerant is compressed into high-pressure gas refrigerant. During heating operation, the above-mentioned cycle is repeated continuously.

A prolonged heating operation may sometimes result in frost forming on the first outdoor heat exchanger 15*a* and the second outdoor heat exchanger 15*b*, leading to decreased heat exchange efficiency of the first outdoor heat exchanger 15*a* and the second outdoor heat exchanger 15*b*. A defrosting operation or a heating defrosting simultaneous operation is thus periodically performed to melt the frost that has formed on the first outdoor heat exchanger 15*a* and the second outdoor heat exchanger 15*b*. A defrosting operation is an operation of supplying high-temperature, high-pressure gas refrigerant to both the first outdoor heat exchanger 15*a* and the second outdoor heat exchanger 15*b*, and defrosting both the first outdoor heat exchanger 15*a* and the second outdoor heat exchanger 15*b* by using heat rejected from the refrigerant. A heating defrosting simultaneous operation is an operation of supplying high-temperature, high-pressure gas refrigerant to one of the first outdoor heat exchanger 15*a* and the second outdoor heat exchanger 15*b* to defrost the one outdoor heat exchanger, while causing the other of the first outdoor heat exchanger 15*a* and the second outdoor heat exchanger 15*b* to serve as an evaporator to thereby continue heating.

Figure 3:
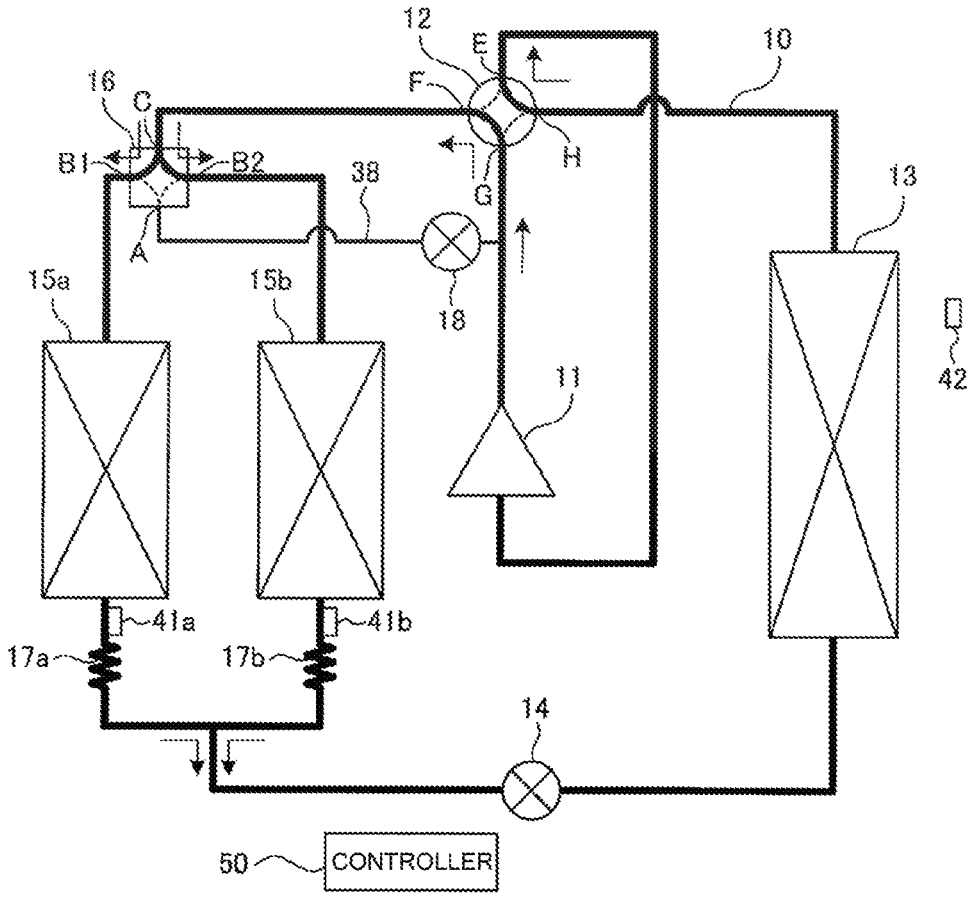
FIG. 3 illustrates a defrosting operation of the refrigeration cycle apparatus according to Embodiment 1 of the present invention.

A defrosting operation of the refrigeration cycle apparatus will be described below. FIG. 3 illustrates a defrosting operation of the refrigeration cycle apparatus according to Embodiment 1. As illustrated in FIG. 3, during defrosting operation, the first flow switching device 12 is set in the second state in which the port E communicates with the port H and the port F communicates with the port G. The second flow switching device 16 is set in the first state in which the port C communicates with both the port B1 and the port B2. The flow control valve 18 is set in, for example, a closed state. During defrosting operation, the first flow switching device 12, the second flow switching device 16, and the flow control valve 18 are set in the same manner as during cooling operation.

High-pressure gas refrigerant discharged from the compressor 11 passes through the first flow switching device 12 and then splits in the second flow switching device 16 into two streams, one flowing into the first outdoor heat exchanger 15*a* and the other flowing into the second outdoor heat exchanger 15*b*. During defrosting operation, the first outdoor heat exchanger 15*a* and the second outdoor heat exchanger 15*b* both serve as condensers. That is, in the first outdoor heat exchanger 15*a* and the second outdoor heat exchanger 15*b*, frost forming on each of the first outdoor heat exchanger 15*a* and the second outdoor heat exchanger 15*b* is melted by heat rejected from the refrigerant flowing inside the outdoor heat exchanger. The first outdoor heat exchanger 15*a* and the second outdoor heat exchanger 15*b* are thus defrosted. The gas refrigerant entering the first outdoor heat exchanger 15*a* and the gas refrigerant entering the second outdoor heat exchanger 15*b* each condense into liquid refrigerant.

The liquid refrigerant leaving the first outdoor heat exchanger 15*a* is reduced in pressure in the capillary tube 17*a*. The liquid refrigerant leaving the second outdoor heat exchanger 15*b* is reduced in pressure in the capillary tube 17*b*. These two liquid refrigerant streams then combine, and the resulting refrigerant has its pressure further reduced by the expansion valve 14 and changes to low-pressure two-phase refrigerant. After leaving the expansion valve 14, the two-phase refrigerant flows into the indoor heat exchanger 13. During defrosting operation, the indoor heat exchanger 13 serves as an evaporator. That is, in the indoor heat exchanger 13, the heat of evaporation of the refrigerant flowing inside the indoor heat exchanger 13 is removed from indoor air. The two-phase refrigerant entering the indoor heat exchanger 13 thus evaporates into low-pressure gas refrigerant. After leaving the indoor heat exchanger 13, the gas refrigerant is sucked into the compressor 11 via the first flow switching device 12. The gas refrigerant sucked into the compressor 11 is compressed into high-pressure gas refrigerant. During defrosting operation, the above-mentioned cycle is repeated continuously.

Figure 4:
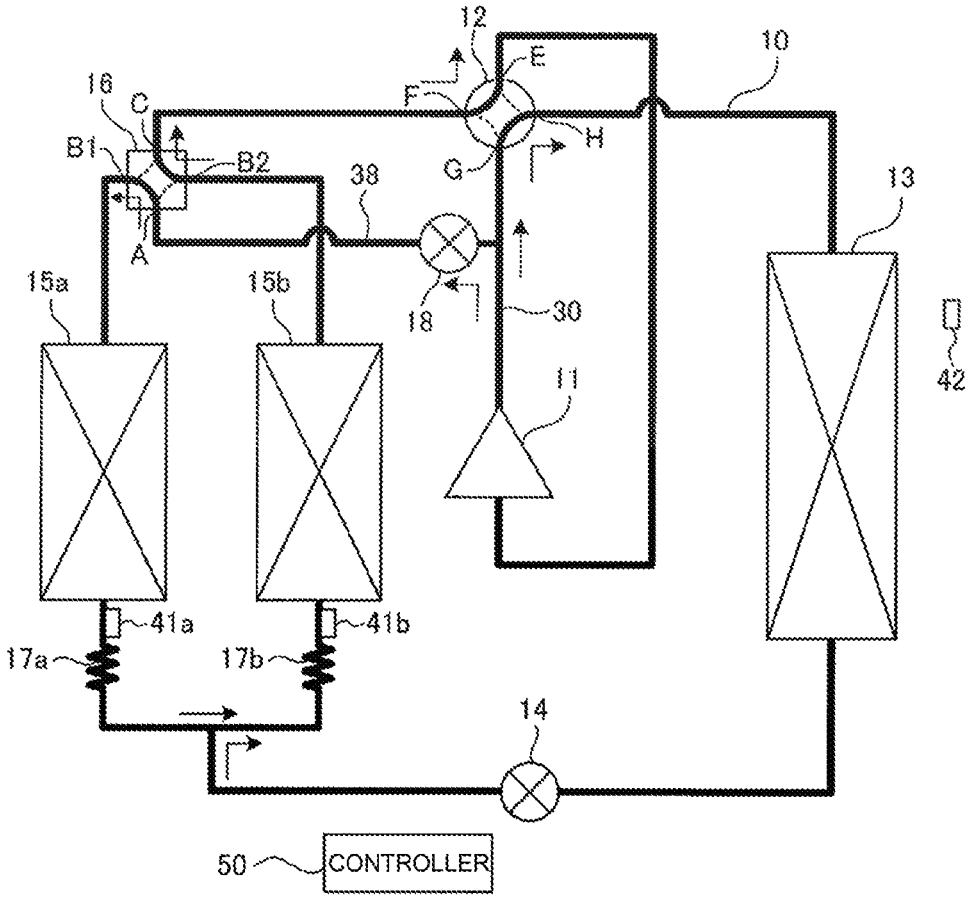
FIG. 4 illustrates a heating defrosting simultaneous operation of the refrigeration cycle apparatus according to Embodiment 1 of the present invention.

A heating defrosting simultaneous operation of the refrigeration cycle apparatus will be described below. FIG. 4 illustrates a heating defrost simultaneous operation of the refrigeration cycle apparatus according to Embodiment 1. A heating defrosting simultaneous operation includes a first operation and a second operation. The first operation, which is performed to defrost the first outdoor heat exchanger 15*a*, is an operation of defrosting the first outdoor heat exchanger 15*a* while carrying out heating. In the first operation, the first outdoor heat exchanger 15*a* and the indoor heat exchanger 13 each serve as a condenser, and the second outdoor heat exchanger 15*b* serves as an evaporator. The second operation, which is performed to defrost the second outdoor heat exchanger 15*b*, is an operation of defrosting the second outdoor heat exchanger 15*b* while carrying out heating. In the second operation, the second outdoor heat exchanger 15*b* and the indoor heat exchanger 13 each serve as a condenser, and the first outdoor heat exchanger 15*a* serves as an evaporator. It is desired that during one run of heating defrosting simultaneous operation, the first operation and the second operation be run alternately, each at least once. FIG. 4 illustrates the first operation of heating defrosting simultaneous operation.

As illustrated in FIG. 4, during the first operation of heating defrosting simultaneous operation, the first flow switching device 12 is set in the first state in which the port E communicates with the port F and the port G communicates with the port H. The second flow switching device 16 is set in the second state in which the port A communicates with the port B1 and the port C communicates with the port B2. The flow control valve 18 is set in an open state at a predetermined opening degree when the first operation is started. Thereafter, the opening degree of the flow control valve 18 is controlled as described later.

Part of high-pressure gas refrigerant discharged from the compressor 11 is diverted from the pipe 30 to the bypass flow path 38. The flow rate of refrigerant diverted to the bypass flow path 38 varies with the opening degree of the flow control valve 18. The gas refrigerant diverted to the bypass flow path 38 has its pressure reduced by the flow control valve 18 to an intermediate pressure, and then flows into the first outdoor heat exchanger 15*a* via the second flow switching device 16. An intermediate pressure in this case refers to a pressure higher than the suction pressure of the compressor 11 and lower than the discharge pressure of the compressor 11. In the first outdoor heat exchanger 15*a*, frost forming on the first outdoor heat exchanger 15*a* is melted by heat rejected from the refrigerant flowing inside the first outdoor heat exchanger 15*a*. The first outdoor heat exchanger 15*a* is thus defrosted. The gas refrigerant entering the first outdoor heat exchanger 15*a* condenses into liquid or two-phase refrigerant at an intermediate pressure, which then leaves the first outdoor heat exchanger 15*a* before being reduced in pressure in the capillary tube 17*a*.

Of the high-pressure gas refrigerant discharged from the compressor 11, gas refrigerant other than the part of the gas refrigerant diverted to the bypass flow path 38 flows into the indoor heat exchanger 13 via the first flow switching device 12. In the indoor heat exchanger 13, heat is exchanged between refrigerant flowing inside the indoor heat exchanger 13, and indoor air sent by the indoor fan, and the heat of condensation of the refrigerant is rejected to the indoor air. The gas refrigerant entering the indoor heat exchanger 13 thus condenses into high-pressure liquid refrigerant. The indoor air sent by the indoor fan is heated by heat rejected from the refrigerant.

After leaving the indoor heat exchanger 13, the liquid refrigerant has its pressure reduced by the expansion valve 14 and changes to low-pressure two-phase refrigerant. After leaving the expansion valve 14, the two-phase refrigerant combines with the liquid or two-phase refrigerant whose pressure has been reduced in the capillary tube 17*a*. The resulting refrigerant then passes through the capillary tube 17*b* into the second outdoor heat exchanger 15*b*. In the second outdoor heat exchanger 15*b*, heat is exchanged between refrigerant flowing inside the second outdoor heat exchanger 15*b*, and outdoor air sent by the outdoor fan, and the heat of evaporation of the refrigerant is removed from the outdoor air. The two-phase refrigerant entering the second outdoor heat exchanger 15*b* thus evaporates into low-pressure gas refrigerant. After leaving the second outdoor heat exchanger 15*b*, the gas refrigerant passes through the second flow switching device 16 and the first flow switching device 12 before being sucked into the compressor 11. The gas refrigerant sucked into the compressor 11 is compressed into high-pressure gas refrigerant. During the first operation of heating defrosting simultaneous operation, the above-mentioned cycle is repeated continuously. The first outdoor heat exchanger 15*a* is thus defrosted while heating is continued.

Although not illustrated, during the second operation of heating defrosting simultaneous operation, the first flow switching device 12 is set in the first state in the same manner as during the first operation. The second flow switching device 16 is set in the third state in which the port A communicates with the port B2 and the port C communicates with the port B1. As a result, during the second operation, the second outdoor heat exchanger 15*b* is defrosted while heating is continued.

Figure 5:
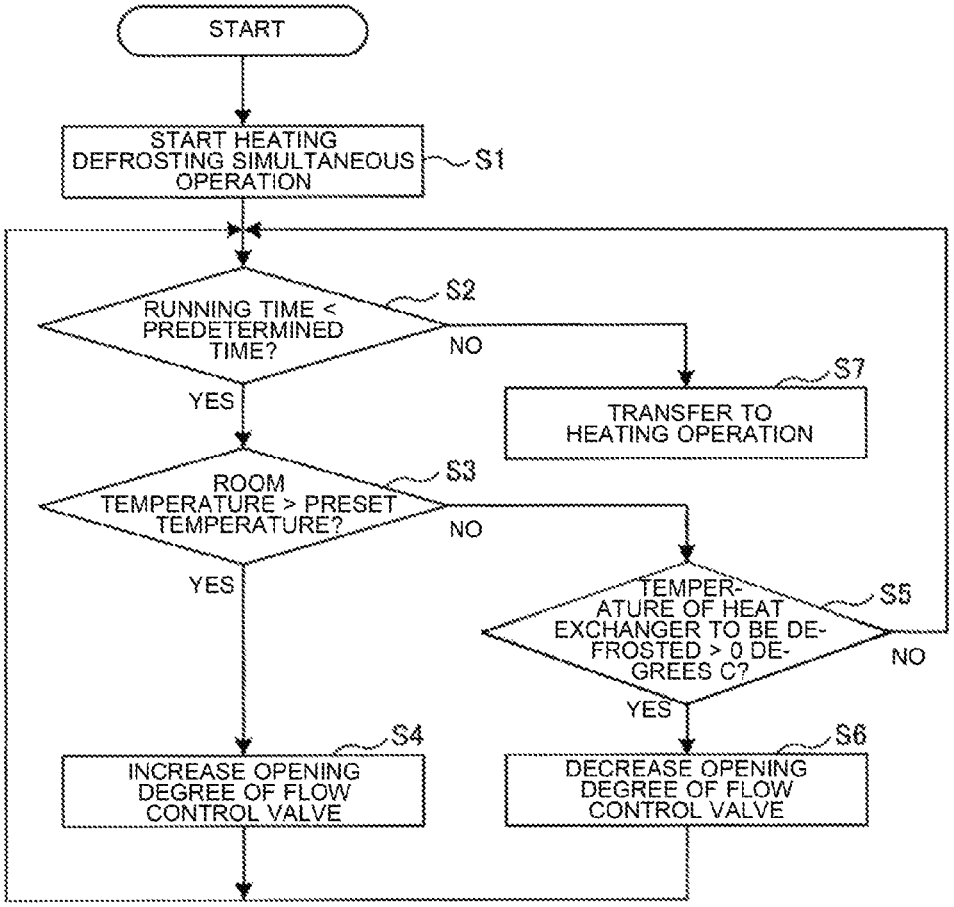
FIG. 5 is a flowchart of processing performed by a controller 50 of the refrigeration cycle apparatus according to Embodiment 1 of the present invention.

FIG. 5 is a flowchart of processing performed by the controller 50 of the refrigeration cycle apparatus according to Embodiment 1. The processing illustrated in FIG. 5 is performed when a preset condition for performing a heating defrosting simultaneous operation is met. For simplicity, it is assumed that in the processing illustrated in FIG. 5, only one of the first and second operations of heating defrosting simultaneous operation is performed. First, at step S1, the controller 50 starts the heating defrosting simultaneous operation. As a result, the first flow switching device 12 is set in the first state, the second flow switching device 16 is set in the second state or the third state, and the flow control valve 18 is set in an open state at a predetermined opening degree. The controller 50 may be configured to, in performing a heating defrosting simultaneous operation, raise the operating frequency of the compressor 11 to the maximum operating frequency.

Next, at step S2, the controller 50 compares a running time, which represents how long a heating defrosting simultaneous operation has been running since its start, with a predetermined time previously set and stored in the ROM to thereby determine whether the running time is less than the predetermined time. If the running time is determined to be less than the predetermined time, the processing proceeds to step S3. If the running time is determined to be greater than or equal to the predetermined time, the processing proceeds to step S7.

At step S3, the controller 50 compares a room temperature acquired based on a detection signal from the temperature sensor 42, with a preset temperature stored in the ROM as a target room temperature, and determines whether the room temperature is higher than the preset temperature. If the room temperature is determined to be higher than the preset temperature, the processing proceeds to step S4. If the room temperature is determined to be lower than or equal to the preset temperature, the processing proceeds to step S5.

At step S4, the controller 50 causes the opening degree of the flow control valve 18 to increase. This increases the flow rate of refrigerant supplied to the heat exchanger to be defrosted, leading to increased defrost capacity of the refrigeration cycle apparatus. Meanwhile, the flow rate of refrigerant supplied to the indoor heat exchanger 13 decreases, leading to decreased heating capacity of the refrigeration cycle apparatus. Step S4 is performed if the room temperature is higher than the preset temperature and the heating capacity is thus excessive. Accordingly, part of such excess heating capacity is directed to the defrost capacity. This makes it possible to maintain the room temperature while facilitating melting of frost on the heat exchanger to be defrosted. Therefore, defrosting can be completed within a certain preset amount of time, and unmelted frost can be prevented from remaining on the heat exchanger. After step S4 is finished, the processing returns to step S2.

At step S5, the controller 50 determines whether the temperature of the heat exchanger to be defrosted, which is acquired based on a detection signal from the temperature sensor 41*a* or the temperature sensor 41*b*, is higher than 0 degrees C. If the temperature of the heat exchanger to be defrosted is determined to be higher than 0 degrees C., the processing proceeds to S6. If the temperature of the heat exchanger to be defrosted is determined to be lower than or equal to 0 degrees C., the processing proceeds to step S2.

At step S6, the controller 50 causes the opening degree of the flow control valve 18 to decrease. This decreases the flow rate of refrigerant supplied to the heat exchanger to be defrosted, leading to decreased defrost capacity of the refrigeration cycle apparatus. Meanwhile, the flow rate of refrigerant supplied to the indoor heat exchanger 13 increases, leading to increased heating capacity of the refrigeration cycle apparatus. Step S6 is performed if the room temperature is lower than or equal to a temperature, and if the temperature of the heat exchanger to be defrosted is higher than 0 degrees C. That is, step S6 is performed if the heating capacity is insufficient, and if the defrost capacity is excessive. Accordingly, part of such excess defrost capacity is directed to the heating capacity. This helps to prevent unmelted frost from remaining on the heat exchanger while allowing for increased room temperature. After step S6 is finished, the processing returns to step S2.

At step S7, the controller 50 ends the heating defrosting simultaneous operation, and transfers to a heating operation.

Figure 6:
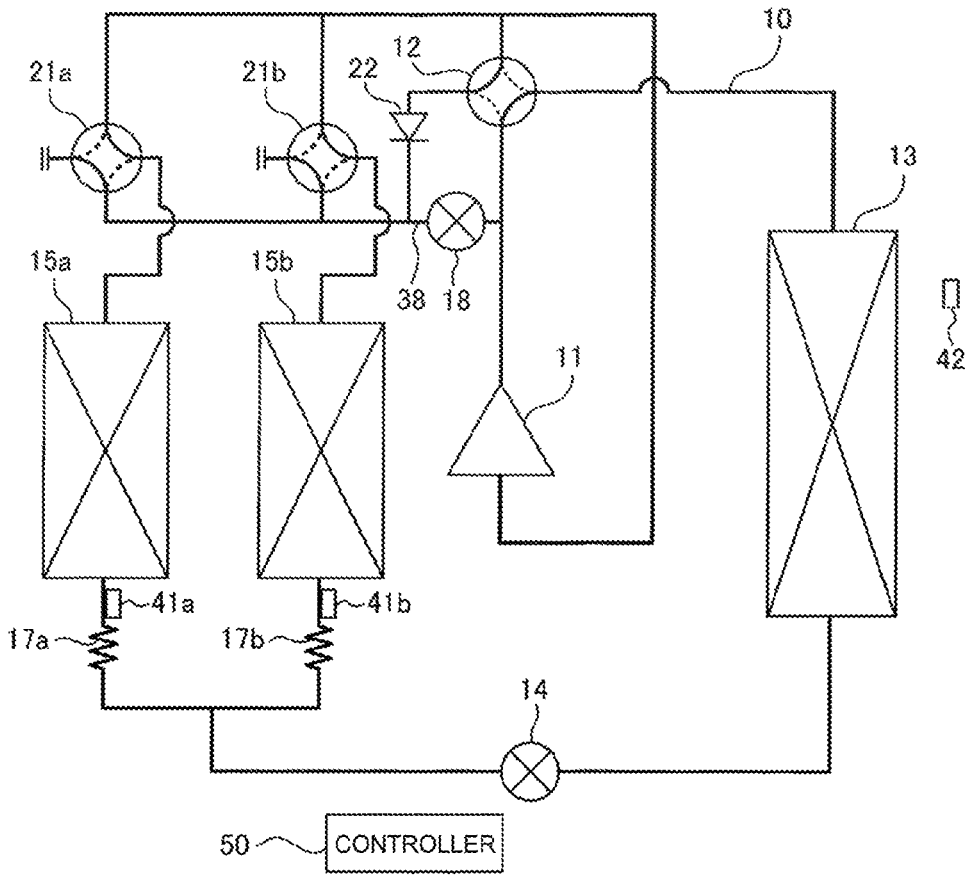
FIG. 6 is a refrigerant circuit diagram illustrating a modification of the configuration of the refrigeration cycle apparatus according to Embodiment 1 of the present invention.

FIG. 6 is a refrigerant circuit diagram illustrating a modification of the configuration of the refrigeration cycle apparatus according to Embodiment 1. As compared with the refrigerant circuit 10 illustrated in FIG. 1, the refrigerant circuit 10 according to this modification includes, instead of the second flow switching device 16, two four-way valves 21*a* and 21*b*, and a check valve 22. The four-way valves 21*a* and 21*b* are controlled by the controller 50. Although the refrigerant circuit 10 according to this modification is more complex in configuration than the refrigerant circuit 10 illustrated in FIG. 1, the refrigerant circuit 10 according to this modification is configured to be able to perform at least a heating defrosting simultaneous operation in the same manner as the refrigerant circuit 10 illustrated in FIG. 1. In the heating defrosting simultaneous operation, part of refrigerant discharged from the compressor 11 is supplied to one of the first outdoor heat exchanger 15*a* and the second outdoor heat exchanger 15*b* via the bypass flow path 38. Embodiment 1 can be also applied to a refrigeration cycle apparatus including the refrigerant circuit 10 according to this modification. Further, Embodiment 1 can be applied to a refrigeration cycle apparatus including a refrigerant circuit other than the refrigerant circuit 10 according to this modification, as long as such a refrigerant circuit is configured to be able to perform a heating defrosting simultaneous operation.

As described above, the refrigeration cycle apparatus according to Embodiment 1 includes the refrigerant circuit 10, and the controller 50. The refrigerant circuit 10 includes the compressor 11, the indoor heat exchanger 13, the first outdoor heat exchanger 15*a*, and the second outdoor heat exchanger 15*b*, and circulates refrigerant. The controller 50 is configured to control the refrigerant circuit 10. The refrigerant circuit 10 further includes the bypass flow path 38, and the flow control valve 18. The bypass flow path communicates between the discharge side of the compressor 11 and the first outdoor heat exchanger 15*a* or between the discharge side of the compressor 11 and the second outdoor heat exchanger 15*b*. The flow control valve 18 is provided to the bypass flow path 38. The indoor heat exchanger 13 is configured to exchange heat between the refrigerant and the air to be supplied to an indoor space. The refrigerant circuit 10 is configured to be able to perform a heating defrosting simultaneous operation. The heating defrosting simultaneous operation is an operation of supplying part of the refrigerant discharged from the compressor 11 to one of the first outdoor heat exchanger 15*a* and the second outdoor heat exchanger 15*b* via the bypass flow path 38, causing the other of the first outdoor heat exchanger 15*a* and the second outdoor heat exchanger 15*b* to serve as an evaporator, and causing the indoor heat exchanger 13 to serve as a condenser. The controller 50 is configured to, during heating defrosting simultaneous operation, control the opening degree of the flow control valve 18 based on a room temperature. In this regard, the air to be supplied to the indoor space is an example of a heating target. The room temperature is an example of the temperature of the heating target.

With the above-mentioned configuration, during heating defrosting simultaneous operation, the opening degree of the flow control valve 18 is controlled based on the room temperature. Excess heating capacity can be thus directed to the defrost capacity. This makes it possible to maintain the room temperature while facilitating defrosting. Consequently, according to Embodiment 1, during heating defrosting simultaneous operation, the ratio between the heating capacity and the defrost capacity can be adjusted in accordance with the heating load. Therefore, the heating defrosting simultaneous operation can be performed in a stable manner.

For instance, during heating defrosting simultaneous operation, if the heating capacity is excessive relative to the load, the heating capacity can be decreased also by decreasing the rotation speed of the compressor 11. In this case, however, not only the heating capacity but also the defrost capacity decreases. As a consequence, defrosting may not be completed within a predetermined defrost time, which may cause unmelted frost to remain on the heat exchanger to be defrosted. By contrast, with Embodiment 1, excess heating capacity is directed to the defrost capacity. This makes it possible to more reliably prevent unmelted frost from remaining.

The amount of frost forming on the heat exchanger at the start of defrosting varies with the operating condition. For this reason, if the flow control valve 18 is set at a fixed opening degree, some frost may remain unmelted when there is a large amount of frost forming on the heat exchanger. By contrast, with Embodiment 1, excess heating capacity is directed to the defrost capacity through control of the opening degree of the flow control valve 18. This makes it possible to more reliably prevent unmelted frost from remaining.

With the refrigeration cycle apparatus according to Embodiment 1, the controller 50 is configured to, during heating defrosting simultaneous operation, increase the opening degree of the flow control valve 18 if the room temperature is higher than a preset temperature set as a target room temperature. A room temperature higher than the preset temperature can be determined to be indicative of excessive heating capacity. Therefore, this configuration makes it possible to more reliably determine whether there is any excess heating capacity, thus ensuring that the heating capacity does not become insufficient after part of the heating capacity is directed to the defrost capacity.

With the refrigeration cycle apparatus according to Embodiment 1, the controller 50 is configured to, during heating defrosting simultaneous operation, control the opening degree of the flow control valve 18 also based on the temperature of the other of the first outdoor heat exchanger 15*a* and the second outdoor heat exchanger 15*b*. With the above-mentioned configuration, during heating defrosting simultaneous operation, the opening degree of the flow control valve 18 is controlled based on the temperature of the heat exchanger to be defrosted. Excess defrost capacity can be thus directed to the heating capacity. This helps to prevent unmelted frost from remaining on the heat exchanger to be defrosted, while allowing for increased heating capacity.

With the refrigeration cycle apparatus according to Embodiment 1, the controller 50 is configured to, during heating defrosting simultaneous operation, decrease the opening degree of the flow control valve 18 if the temperature of the other of the first outdoor heat exchanger 15*a* and the second outdoor heat exchanger 15*b* is higher than 0 degrees C. If the temperature of the heat exchanger to be defrosted is higher than 0 degrees C., this can be determined to be indicative of excessive defrost capacity. Therefore, this configuration makes it possible to more reliably determine whether there is any excess defrost capacity, thus ensuring that the defrost capacity does not become insufficient after part of the defrost capacity is directed to the heating capacity.

Although the foregoing description of Embodiment 1 is directed to an exemplary air-conditioning apparatus used to heat air, this is not intended to be limiting. The present invention can be also applied to other refrigeration cycle apparatuses used to heat hot water, such as hot-water supply apparatuses or hot-water floor heating apparatuses.

REFERENCE SIGNS LIST

10 refrigerant circuit 11 compressor 12 first flow switching device 13 indoor heat exchanger 14 expansion valve 15*a* first outdoor heat exchanger 15*b* second outdoor heat exchanger 16 second flow switching device 17*a*, 17*b* capillary tube 18 flow control valve 21*a*, 21*b* four-way valve 22 check valve 30, 31, 32, 33, 33*a*, 33*b*, 34, 35, 36, 37 pipe 38 bypass flow path 41*a*, 41*b*, 42 temperature sensor 50 controller.

The invention claimed is:

1. A refrigeration cycle apparatus comprising:

a refrigerant circuit including a compressor, an indoor heat exchanger, a first outdoor heat exchanger, and a second outdoor heat exchanger, the refrigerant circuit circulating refrigerant; and a controller configured to control the refrigerant circuit, the refrigerant circuit further comprising a bypass flow path configured to communicate between a discharge side of the compressor and the first outdoor heat exchanger or between the discharge side of the compressor and the second outdoor heat exchanger, and a flow control valve provided at the bypass flow path, the indoor heat exchanger being configured to exchange heat between the refrigerant and a heating target, the refrigerant circuit being configured to be able to perform a heating defrosting simultaneous operation of supplying part of the refrigerant discharged from the compressor to one of the first outdoor heat exchanger and the second outdoor heat exchanger via the bypass flow path, causing an other of the first outdoor heat exchanger and the second outdoor heat exchanger to serve as an evaporator, and causing the indoor heat exchanger to serve as a condenser, the controller being configured to, during the heating defrosting simultaneous operation, increase the opening degree of the flow control valve if the temperature of the heating target is higher than a preset temperature, the preset temperature being a target value of the temperature of the heating target, and control the opening degree of the flow control valve based on a temperature of the one of the first outdoor heat exchanger and the second outdoor heat exchanger if the temperature of the heating target is equal to or lower than the preset temperature.

2. The refrigeration cycle apparatus of claim 1, wherein the controller is configured to, during the heating defrosting simultaneous operation, decrease the opening degree of the flow control valve if the temperature of the one of the first outdoor heat exchanger and the second outdoor heat exchanger is higher than 0 degrees C.

* * * * *